US011466948B2

(12) United States Patent
Litvinov et al.

(10) Patent No.: US 11,466,948 B2
(45) **Date of Patent: *Oct. 11, 2022**

(54) SPEED LOADER

(71) Applicant: Makeovation, Inc., San Carlos, CA (US)

(72) Inventors: Yuri Litvinov, San Francisco, CA (US); Philip J. Houdek, II, San Jose, CA (US)

(73) Assignee: MAKEOVATION, INC., San Carlos, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/340,169

(22) Filed: Jun. 7, 2021

(65) Prior Publication Data

US 2021/0293499 A1 Sep. 23, 2021

Related U.S. Application Data

(63) Continuation of application No. 16/545,270, filed on Aug. 20, 2019, now Pat. No. 11,060,811.

(60) Provisional application No. 62/722,246, filed on Aug. 24, 2018.

(51) Int. Cl.
*F41A 9/85* (2006.01)

(52) U.S. Cl.
CPC ..... *F41A 9/85* (2013.01)

(58) Field of Classification Search
CPC ..... F41A 9/85; F41A 9/82; F41A 15/02
USPC ..... 42/59, 89, 87, 88
See application file for complete search history.

(56) References Cited

U.S. PATENT DOCUMENTS 1,228,505 A * 6/1917 Wesson ..... F41A 9/85 42/89
3,824,729 A * 7/1974 Kubik ..... F41A 9/85 42/89
4,771,561 A * 9/1988 Waiser ..... F41C 3/14 42/59
4,866,870 A * 9/1989 Johnson ..... F41A 9/85 42/89
5,842,299 A * 12/1998 Switzer ..... F41A 9/85 42/88
5,953,845 A * 9/1999 Longwitz ..... F41A 9/85 42/89
8,136,285 B2 * 3/2012 Abell ..... F41A 9/85 224/198
9,702,647 B2 * 7/2017 Head ..... F41A 9/85
(Continued)

*Primary Examiner* — Michael D David
(74) *Attorney, Agent, or Firm* — Bennet K. Langlotz; Langlotz Patent & Trademark Works, LLC

(57) ABSTRACT

A speed loader has a body having a front and an opposed rear, and defining a body axis, the body defining a plurality of cartridge pockets, each pocket open at the front, the body defining a central opening receiving a central shaft movable between a forward position and a rear position, a plurality of latches received by the body and each movable between an extended position away from the body axis and a retracted position nearer the body axis, each latch extending into an associated pocket when in the extended position and being clear of the associated pocket when in the retracted position, and each latch being responsive to the position of the central shaft wherein each latch is restrained in the extended position when the shaft is in the forward position and is enabled to move to the retracted position when the shaft is in the rear position.

7 Claims, 7 Drawing Sheets

(56) References Cited

U.S. PATENT DOCUMENTS

| | | | | |
|---|---|---|---|---|
| 9,909,827 | B1 * | 3/2018 | Higby | F41A 9/85 |
| 10,222,156 | B2 * | 3/2019 | Head | F42B 39/02 |
| 10,612,875 | B1 * | 4/2020 | Roe | F41A 9/85 |
| 2020/0064094 | A1 * | 2/2020 | Litvinov | F41A 9/85 |

* cited by examiner

SPEED LOADER

CROSS-REFERENCE TO RELATED APPLICATION

This application is a Continuation of U.S. patent application Ser. No. 16/545,270 filed on Aug. 20, 2019, entitled "SPEED LOADER," which claims the benefit of U.S. Provisional Patent Application No. 62/722,246 filed on Aug. 24, 2018, entitled "REVOLVER SPEED LOADER," which are hereby incorporated by reference in their entirety for all that is taught and disclosed therein.

Field of the Invention

The present invention relates to firearms, and more particularly to a speed loader that quickly loads cartridges into a revolver.

Background of the Invention

Those skilled in the art have continually sought improved methods for quickly loading cartridges into a revolver. Some past inventions generally sought to load the cartridges simultaneously, which is a preferred method, but those inventions have had significant shortcomings in terms of construction complexity, reliability, retaining cartridges when dropped, accidental release of cartridges, ease of handling, ease of user manipulation while loading cartridges into the loader, ease of user manipulation while using the loader to load cartridges into the revolver, lack of device physical feedback to the user upon the release of the cartridges, user operation and release of cartridges under stress, and the requirement of precise loader to revolver alignment. One example of a prior art speed loader is U.S. Pat. No. 4,866,870 to Johnson. Although Johnson teaches a speed loader that improves the speed of loading cartridges into a revolver and utilizes a central shaft to retain the cartridges, the Johnson speed loader is bulky, has a complex rear latch mechanism, lacks portability, and has a lot of friction impeding operation of the latch mechanism because of a rotation requirement.

Therefore, a need exists for a new and improved speed loader that quickly loads cartridges into a revolver without requiring a rotating latch mechanism. In this regard, the various embodiments of the present invention substantially fulfill at least some of these needs. In this respect, the speed loader according to the present invention substantially departs from the conventional concepts and designs of the prior art, and in doing so provides an apparatus primarily developed for the purpose of providing a speed loader that quickly loads cartridges into a revolver without requiring a rotating latch mechanism.

SUMMARY OF THE INVENTION

The present invention provides an improved speed loader, and overcomes the above-mentioned disadvantages and drawbacks of the prior art. As such, the general purpose of the present invention, which will be described subsequently in greater detail, is to provide an improved speed loader that has all the advantages of the prior art mentioned above.

To attain this, the preferred embodiment of the present invention essentially comprises a body having a front and an opposed rear, and defining a body axis, the body defining a plurality of cartridge pockets, each pocket open at the front, the body defining a central opening receiving a central shaft movable between a forward position and a rear position, a plurality of latches received by the body and each movable between an extended position away from the body axis and a retracted position nearer the body axis, each latch extending into an associated pocket when in the extended position and being clear of the associated pocket when in the retracted position, and each latch being responsive to the position of the central shaft wherein each latch is restrained in the extended position when the shaft is in the forward position and is enabled to move to the retracted position when the shaft is in the rear position. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
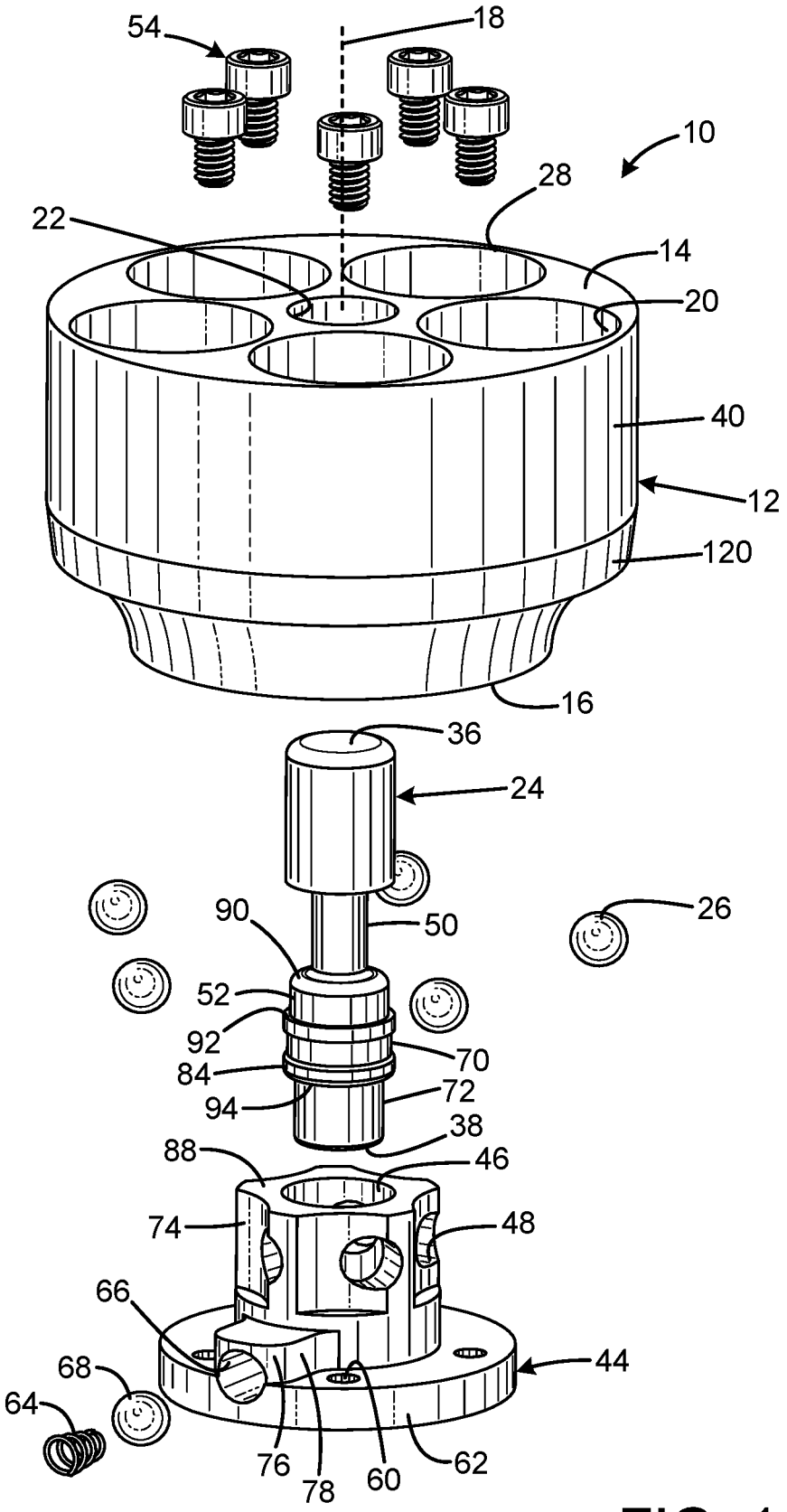
FIG. 1 is an exploded view of the current embodiment of the speed loader constructed in accordance with the principles of the present invention.

An embodiment of the speed loader of the present invention is shown and generally designated by the reference numeral 10.

FIG. 1 illustrates the improved speed loader 10 of the present invention. More particularly, the speed loader has a body 12 having a front 14 and an opposed rear 16, and defining a body axis 18. The body defines a plurality of cartridge pockets 20, each cartridge pocket being open at the front 28. The body defines a central opening 22 receiving a central shaft 24 movable between a forward position and a rear position. A plurality of latches (latch balls 26) are received by the body, each being movable between an extended position away from the body axis and a retracted position nearer the body axis. Each latch extends into an associated cartridge pocket when in the extended position and is clear of the associated cartridge pocket when in the retracted position. Each latch is responsive to the position of the central shaft wherein each latch is restrained in the extended position when the shaft is in the forward position and is enabled to move to the retracted position when the shaft is in the rear position.

Figure 2:
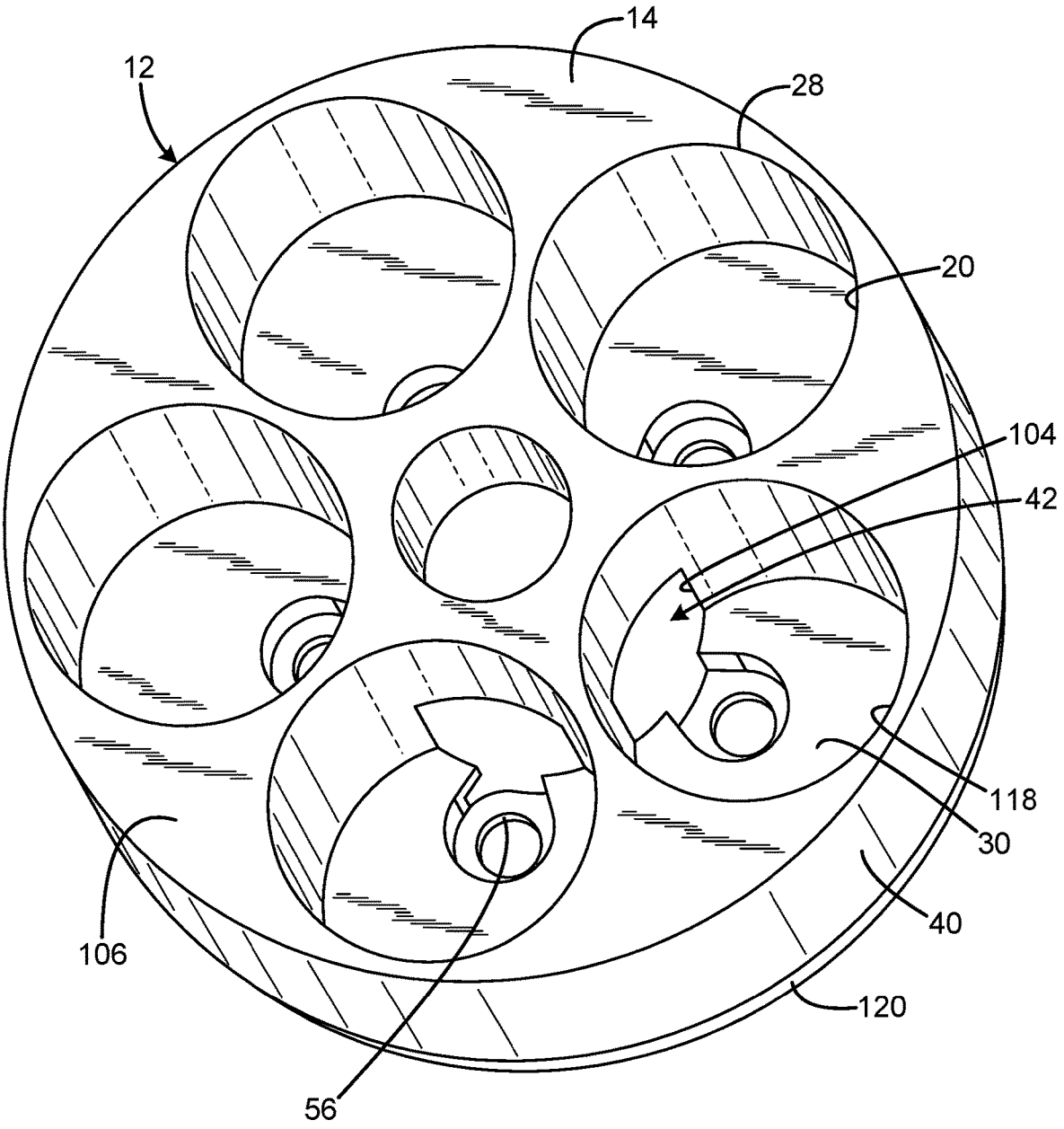
FIG. 2 is a top isometric view of the body of FIG. 1.
Figure 3:
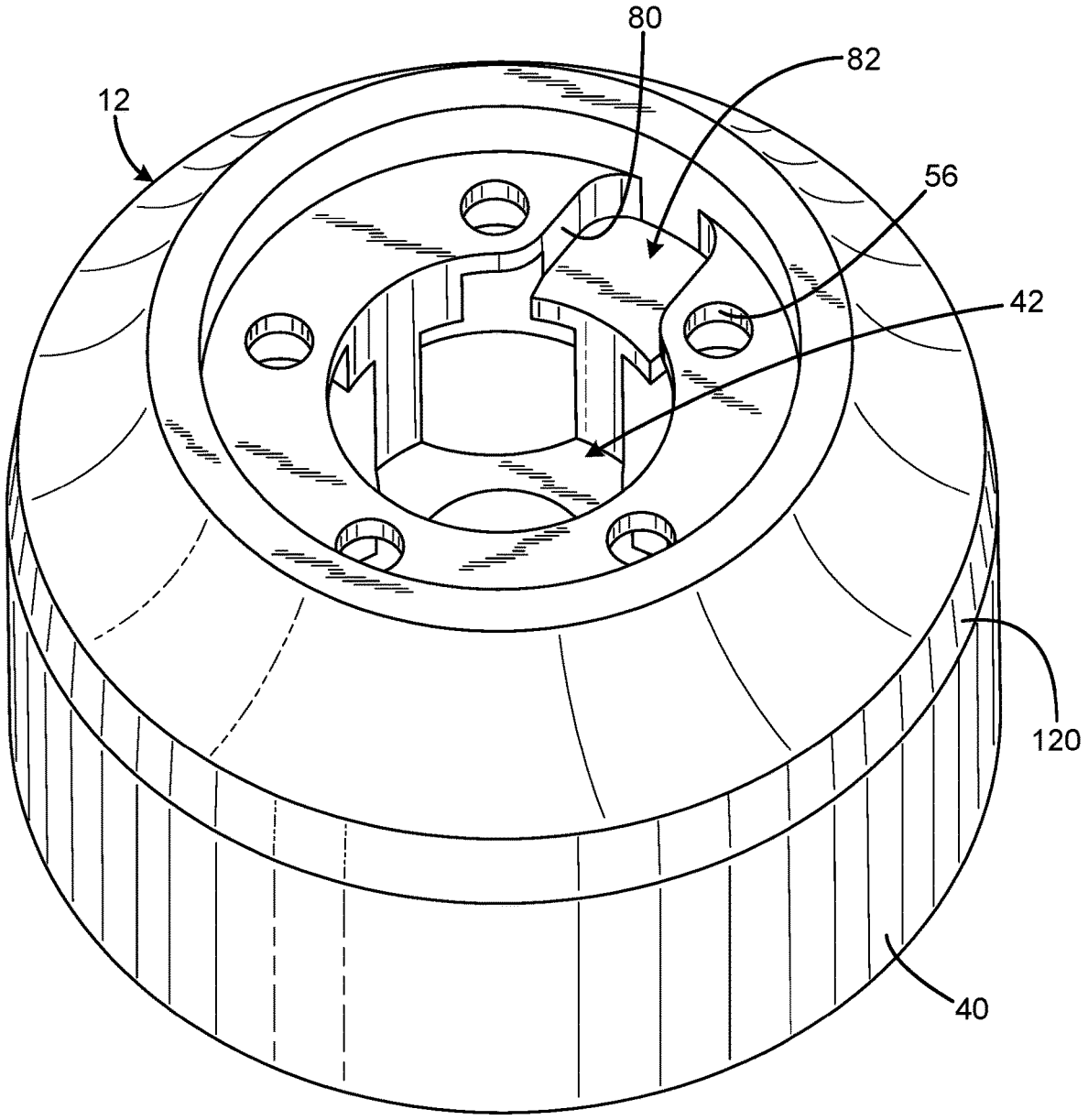
FIG. 3 is a bottom isometric view of the body of FIG. 1.
Figure 4A:
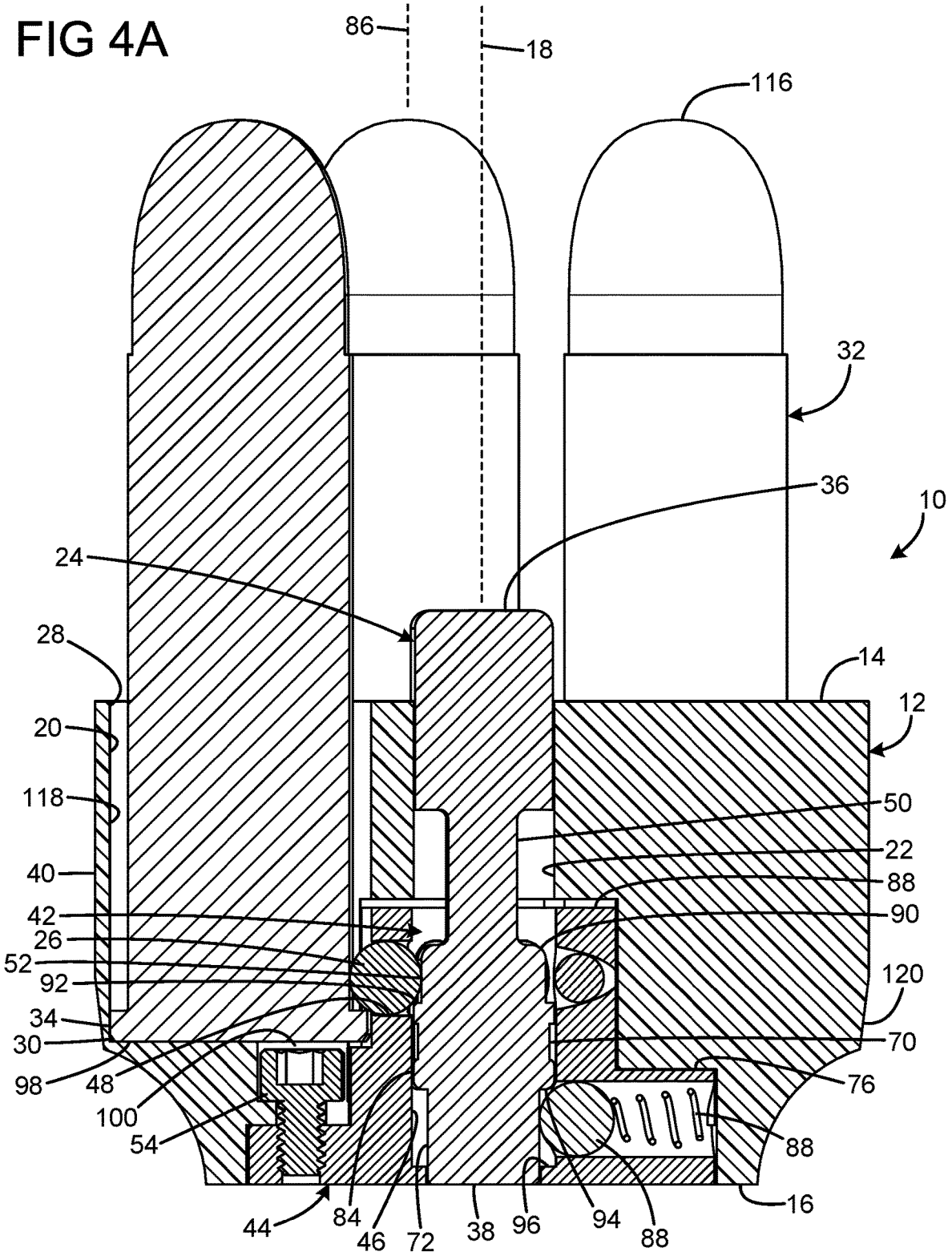
FIG. 4A is a side section view of the speed loader of FIG. 1 with the latches in the extended position.
Figure 4B:
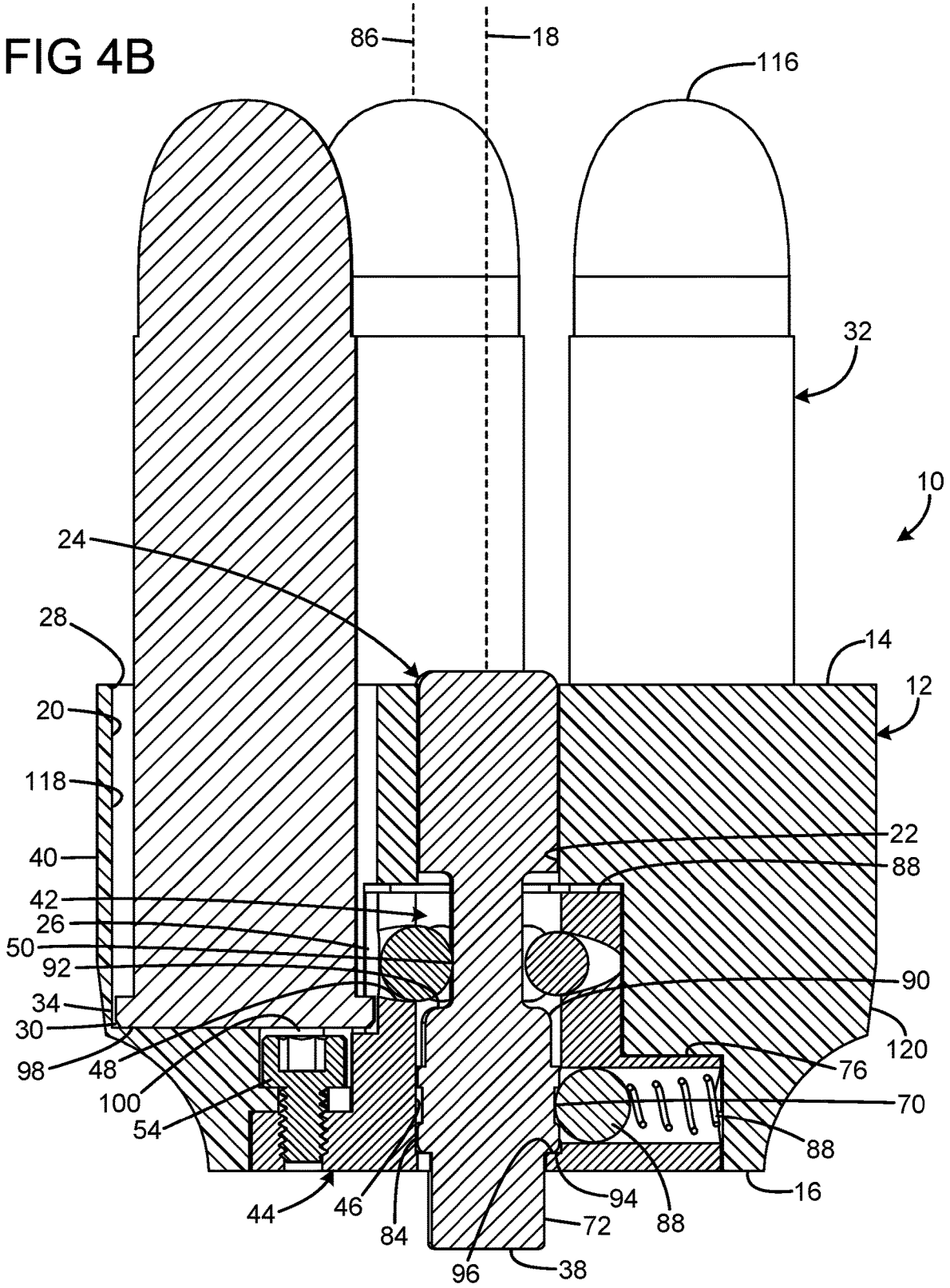
FIG. 4B is a side section view of the speed loader of FIG. 1 with the latches in the retracted position.

FIGS. 2 & 3 illustrate the improved body 12 of the present invention, and FIGS. 4A & 4B illustrate the improved speed loader 10 of the present invention. More particularly, each cartridge pocket 20 has a rear end 30, and each latch (latch balls 26) is positioned forward of and adjacent to the rear end such that the rim 34 of a rimmed cartridge 32 in the cartridge pocket is retained by the latch when the latch is in the extended position (shown in FIG. 4A). The central shaft 24 has a forward end 36 protruding from the front 14 of the body 12 when the central shaft is in the forward position (shown in FIG. 4A). The central shaft has a rear end 38 protruding from the rear 16 of the body when in the rear position (shown in FIG. 4B). When the central shaft is in the rear position, the rimmed cartridges are loose in the cartridge pockets because each latch is in the retracted position, which is their closest position to the body axis 18. The rear end of the central shaft is flush with the rear of the body when the central shaft is in the forward position.

In the current embodiment, the cartridge pockets 20 are arranged in a circular array or ring of cartridge pockets, and the latches (latch balls 26) are spheres. The body 12 that includes a first portion 40 defining the cartridge pockets and a rear cavity 42 communicating with the cartridge pockets. The body also includes a second hub portion 44 defining a central passage 46 for the central shaft 24 and a plurality of radial passages 48 receiving the latches. The radial passages are radially oriented, but are not aligned to intersect the center axis 86 of their associated rimmed cartridge 32. The front of the central passage is wider than the rear of the central passage to provide clearance for the functional steps and features of the central shaft, while the rear of the central passage has a smaller diameter to precisely guide the central shaft as the central shaft reciprocates forward and rearward. The second hub portion defines a plurality of moon recesses 74 that form one section wall of the cartridge pockets. The second hub portion also includes a key 76 feature. The key provides a volume that defines a detent spring hole 66 that receives a detent spring 64 and a portion of a detent ball 68. The key also includes mating flat surfaces 78 that align the second hub portion to flat walls 80 in a pocket 82 in the rear 16 of the body to constrain the angular alignment of the second hub portion and the body. It should be appreciated that the top surface 88 of the second hub portion is generally offset from the interior of the body so the position of the second hub portion is not controlled by the top surface. A rear flange 62 on the second hub portion is also offset from the interior of the body by a small gap when the second hub portion is assembled to the body. The first portion of the body partly encloses the radial passages to retain the latches. The body has a cylindrical form that defines the body axis 18, and the central opening 22 is registered with the body axis.

The central shaft 24 has a first width at a first location 50 along the length of the central shaft that is registered with the latches (latch balls 26) when the central shaft is in the rear position and a larger second diameter at a second location 52 along the length of the central shaft rearward of the first location that is registered with the latches when the central shaft is in the forward position. The first and second locations are separated by a radiused surface 90. While the rounded shape of the latch balls means the radiused surface is not required, the radiused surface reduces the user actuation force needed to move the central shaft axially and reduces wear and fretting on the parts in this contact area. Additional radiused surfaces can be defined by the central shaft to reduce stress concentrations in specific areas. The central shaft also defines a latch ball stop surface 92 that has a sharp edge intersection with the outer diameter of the central shaft. The latch ball stop surface contacts the latch balls when the central shaft is in the forward position to prevent continued forward travel of the central shaft beyond the forward position. The central shaft also defines a rear stop surface 94 that contacts a rear flange stop surface 96 defined by the second hub portion 44 that prevents continued rearward travel of the central shaft beyond the rear position.

The central shaft 24 can be viewed as a restraint actuator having a forward portion within the ring of cartridge pockets 20 and being movable between a forward position and a rear position. The latches (latch balls 26) can be viewed as restraint elements associated with at least one of the cartridge pockets and operable selectively to restrain a rimmed cartridge 32 in an associated cartridge pocket when the restraint actuator is in the forward position. In response to an application of force on the forward portion of the restraint actuator, the restraint actuator is operable to move rearward toward the rear position to enable exit of the rimmed cartridge from the cartridge pocket. In the current embodiment, there can be a separate restraint element for each cartridge pocket. The restraint actuator is rotationally disengaged from the body 12. The restraint actuator is a surface of revolution. The restraint actuator does not rotate and travels only in an axial direction along the body axis 18. The restraint actuator remains in a selected orientation without rotation as the restraint actuator moves between the forward position and the rearward position. The restraint actuator is in the same rotational orientation in the forward position and the rearward position. The central opening 22 is manufactured to a tight tolerance to guide the restraint actuator precisely to prevent excess movement of the restraint actuator and the latches.

The central shaft 24 defines an unlocked detent groove 70 to the rear of the second location 52 and a cylindrical locked detent surface 72 to the rear of the unlocked detent groove. The detent ball 68 is urged inward towards the body axis 18 and into contact with the central shaft by the detent spring 64. Thus, biasing force of the detent spring must be overcome to transition the central shaft from the locked, forward position to the unlocked, rearward position by forcing the detent ball over a radiused shoulder 84 on the central shaft located between the unlocked detent groove and the locked detent surface. The radiused shoulder is not required for operation of the speed loader 10 because the round shape of the detent ball would permit the detent ball to ride over this area even if the area were sharp. However, the radiused shoulder is desirable for reducing contact stress between the detent ball and the central shaft, which reduces part wear and fretting. When the detent ball resides in the unlocked detent groove, the detent spring is in a maximum state of compression. When the detent ball contacts the locked detent surface, the detent spring is in a maximum state of relaxation.

In the current embodiment, the body 12 defines five cartridge pockets 20, each of which receives a .38 caliber rimmed cartridge 32. However, modifications to the body can be made to accommodate any desired quantity of cartridges of any desired caliber. A likely range of cartridge quantities would be from two to ten to accommodate numerous types of revolvers. The body is preferably made of polyoxymethylene plastic for stiffness, dimensional stability, ease of machining, and to prevent scratching of a revolver when loading cartridges. However, the body can also be made of aluminum, titanium, or steel for use in different environments having different user requirements. The user holds the body to manipulate the speed loader 10. In addition to the resistance to axial movement of the central shaft 24 provided by the detent ball 68 and detent spring 64, accidental depression of the central shaft is generally prevented because the forward end 36 of the central shaft is surrounded by the rimmed cartridges when the rimmed cartridges are installed in the cartridge pockets.

The cartridge pockets 20 are cut into the front 14 of the body 12. Socket head cap screws 54, which are size 2-56 in the current embodiment, are used to releasably secure the second hub portion 44 within the rear cavity 42 of the body via a clamping action. The rear end 30 of each cartridge pocket defines an aperture 56 that is sized to receive the cap portion of an associated socket head cap screw and to permit the threaded portion of the socket head cap screw to protrude into the rear cavity of the body to engage a registered threaded aperture 60 defined by the rear flange 62 on the second hub portion. Thus, the cap portions of the socket head cap screws are positioned below the rear end of each cartridge pocket and are separated from the rear 98 of their associated rimmed cartridges 32 by a gap 100. In the current embodiment, there are five socket head cap screws.

Figure 5:
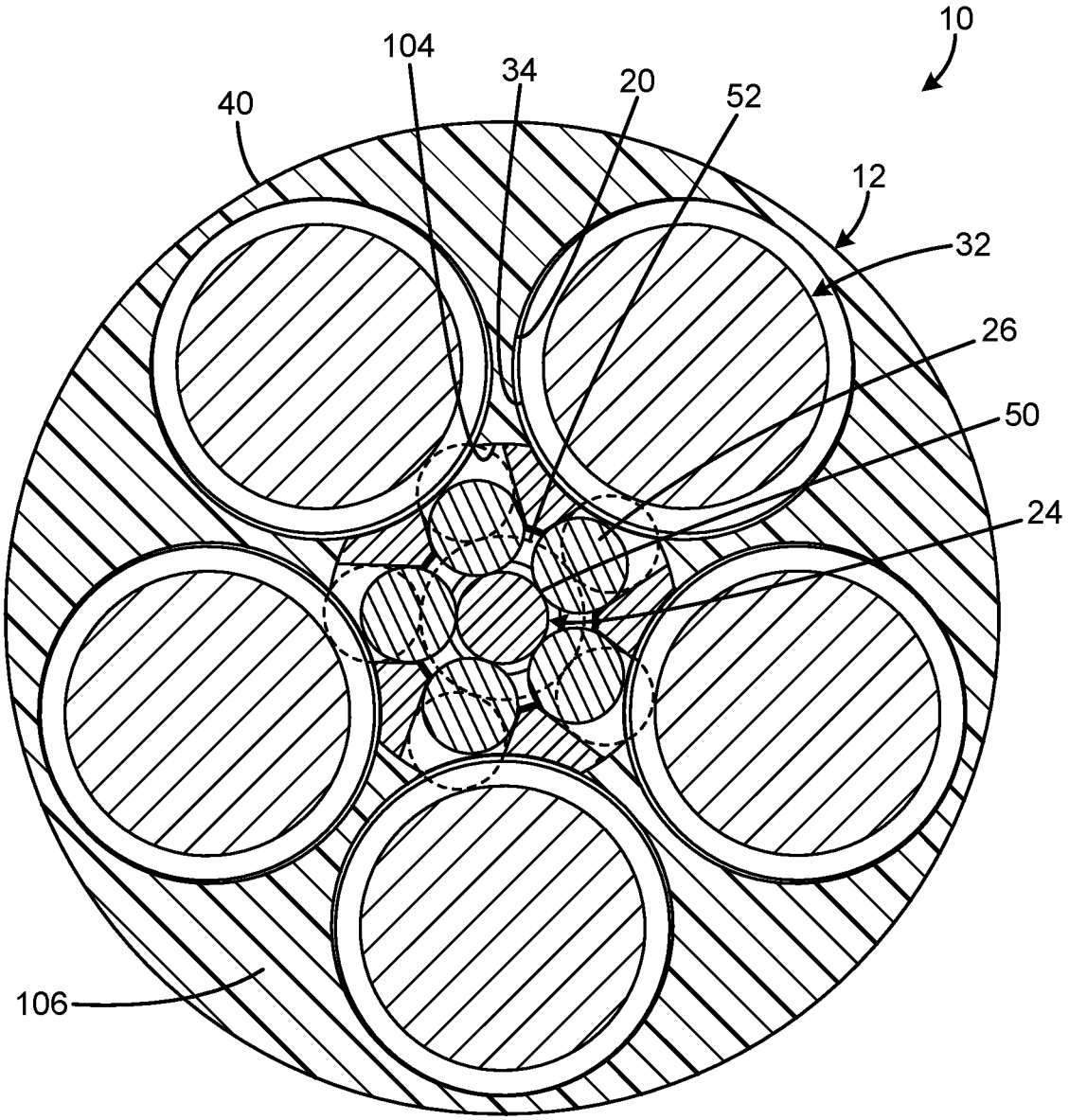
FIG. 5 is a bottom section view of the speed loader of FIG. 1 with the latches shown in the retracted position in solid lines and in the extended position in dashed lines.

FIG. 5 illustrates the improved speed loader 10 of the present invention. More particularly, the latch consists of five latch balls 26, resulting in one latch ball per rimmed cartridge 32. When the central shaft 24 is in the rear, unlocked position (denoted by the solid lines), the latch balls can move towards the axial centerline defined by body axis 18 of the body 12 and away from the cartridge pockets 20 into a space defined by the first location 50 on the central shaft. Because the latch balls no longer engage the rims 34 of the rimmed cartridges, the rimmed cartridges are free to leave the cartridge pockets under the influence of gravity when the speed loader 10 is inverted and load into the cylinder 102 of a revolver. When the central shaft is in the forward, locked position (denoted by the dashed lines), the wider second location 52 on the central shaft pushes the latch balls outward away from the axial centerline defined by the body axis of the body. A portion of the latch balls protrudes into the cartridge pockets and captures the rims of the rimmed cartridges to retain the rimmed cartridges within the cartridge pockets until the central shaft changes state to the rear, unlocked position. The latch balls cannot fall out of the radial passages 48 into the cartridge pockets because the latch balls are stopped by a wall feature (housing stop edge 104 shown in FIGS. 2 & 5) in each cartridge pocket that serves as the motion limit stop for the associated latch ball. It should be appreciated that the thick sidewall regions 106 are not required for proper operation of the speed loader 10. Thus, these regions could be cut away in a pattern to create grip features to enhance user purchase on the speed loader when in use, or could be cut away to provide guide grooves in the axial direction of the central shaft to guide the user's grip, or could be cut away to reduce the volume and/or mass of the speed loader 10.

The current embodiment is preferred because it enables implementation of the concepts of the invention with a small number of parts and simple manufacturing methods. However, other embodiments of the latch, including using parts or element other than balls can be used, including cylindrical, prismatic, and obround shapes. The combination of two balls, a ball and a cylinder, or an obround element per radial passage, may be especially advantageous for revolvers with larger revolver cylinders. In addition, alternative embodiments would be to use two latch balls to retain each rimmed cartridge 32, or to use one latch ball to retain two rimmed cartridges. These approaches could result in easier manufacturing and/or weight reduction of the current invention. Furthermore, two latch balls could be used in a vertically stacked (in the direction of the body axis 18) orientation to allow retention of the rim 34 of a rimmed cartridge with one latch ball and enable axial position guidance from a second latch ball to act as a stop for the brass of the rimmed cartridge further up the length of the rimmed cartridge.

Figure 6:
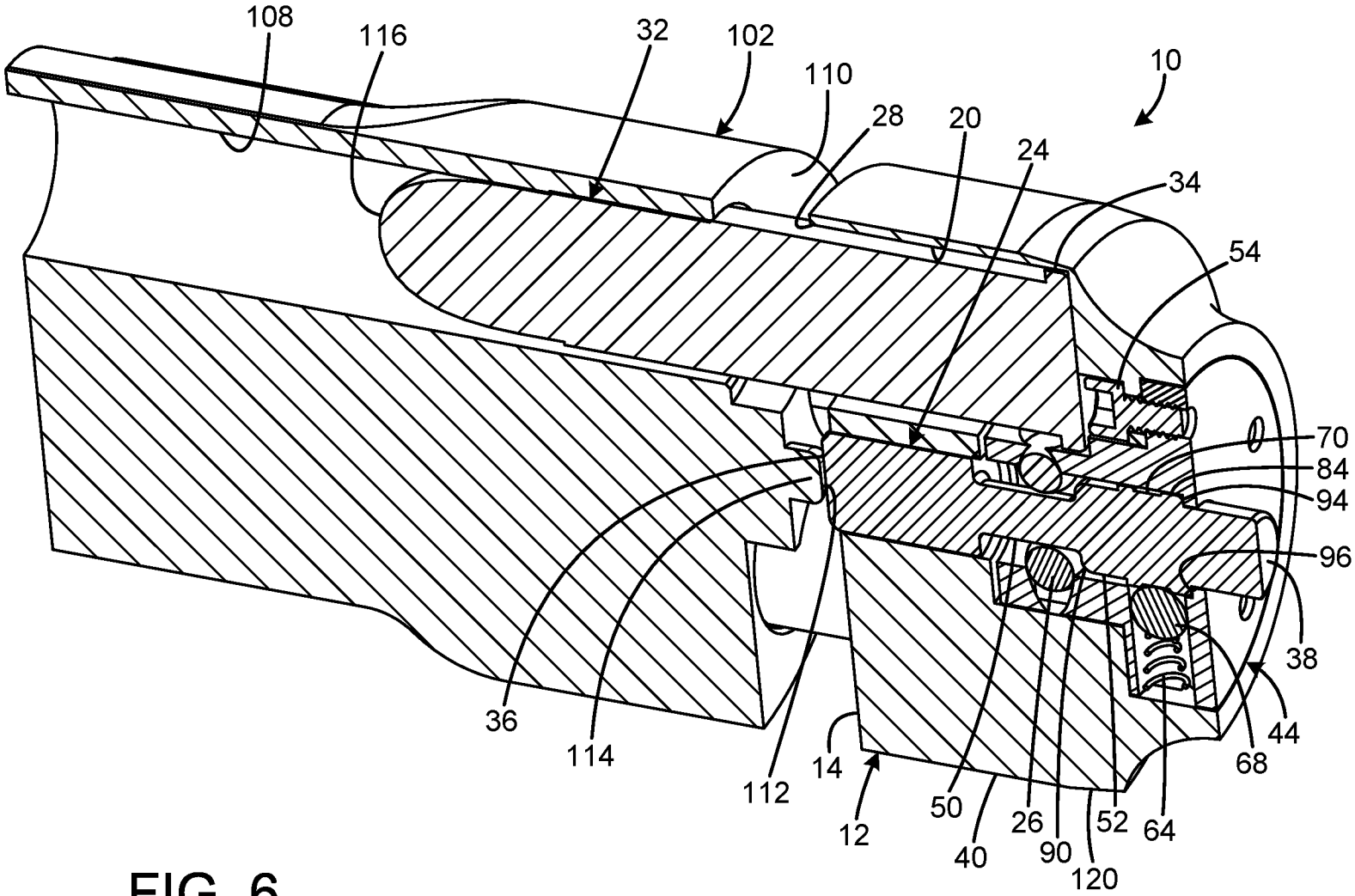
FIG. 6 is an isometric side section view of the speed loader of FIG. 1 in the process of loading cartridges into the cylinder of a revolver with the latches in the retracted position.

FIG. 6 illustrates the improved speed loader 10 of the present invention. More particularly, the speed loader 10 is shown in the process of loading rimmed cartridges 32 into revolver chambers 108 in the rear 110 of the cylinder 102 of a revolver. The forward end 36 of the central shaft 24 is the surface of the central shaft that contacts the centrally located pin 112 of the revolver extractor 114 when the speed loader is used to load the cylinder. The forward end of the central shaft is almost flush with the front 14 of the body 12 when the central shaft is in the rearward position. This position ensures the centrally located pin of the revolver extractor makes solid contact with the forward end of the central shaft, thus releasing the rimmed cartridges upon insertion of the rimmed cartridges and speed loader 10 into the revolver for loading. The narrower first location 50 on the central shaft 24 provides a recess that enables the latches (latch balls 26) to be pushed out of the way by the weight of the rimmed cartridges when the revolver is being loaded while the rimmed cartridges are pointed towards the ground by the user. In use, the user may adopt a 'stress reload' technique where the users fingertips extend towards and near the end of the rimmed cartridges as the speed loader 10 with the rimmed cartridges is lined up with the revolver cylinder. Also, the rounded or angled noses 116 of the cartridges creates lead in geometry to aid the user to align the rimmed cartridges with the revolver chambers 108.

It should be appreciated that once the user has reloaded the speed loader 10 with a new set of rimmed cartridges 32 with the latches (latch balls 26) in their retracted position, the rimmed cartridges may be loosely positioned within their cartridge pockets 20. However, the latches subsequently capture their associated rimmed cartridges within their associated cartridge pockets against the outer wall portion 118 of the cartridge pockets opposite the latches by sliding the rear 98 of the rimmed cartridges on the rear ends 30 of the cartridge pockets when the latches transition from the retracted position to the extended position to releasably secure the rimmed cartridges within the cartridge pockets. This action ensures the rimmed cartridges will be axially registered with the revolver chambers 108 in the rear 110 of the cylinder 102 of a revolver when the user utilizes the speed loader 10 to reload the revolver. Thus, the rimmed cartridges do not sit in the center of each cartridge pocket and are instead shifted along a line of action colinear with their associated radial passages 48. This means the bolt circle of the cartridge pockets is slightly smaller than the bolt circle of the cylinder the speed loader 10 is sized to load. This small shift is a function of the exact geometry of the latch balls, the angular position and size of the radial passages where they open into the cartridge pockets, and the placement of the cartridge pockets with respect to the central opening 22 of the body 12. Furthermore, a tapered region 120 provides extra installation clearance for revolvers lacking much space for the speed loader 10 behind the rear of the cylinder during the cartridge loading process.

While a current embodiment of the speed loader has been described in detail, it should be apparent that modifications and variations thereto are possible, all of which fall within the true spirit and scope of the invention. For example, the central shaft could have an alternative outer profile other than the square steps described. Such an alternative profile could include a cone or ramp that the latch balls ride on to move them into position. The ramp feature could be combined with a center spring so that the latch balls are urged into place, which could be advantageous for operation and manufacturing of the current invention. In this case, the central shaft would move against the biasing force of the center spring and would not need to extend out from the bottom of the body. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A speed loader for a revolver comprising:

a body having a front and an opposed rear;

the body defining a ring of cartridge pockets;

each pocket open at the front;

a restraint actuator having a forward portion within the ring of cartridge pockets and movable between a forward position and a rear position;

a restraint element associated with at least one of the cartridge pockets and operable selectively to restrain a rimmed cartridge in the associated cartridge pocket when the restraint actuator is in the forward position, and in response to an application of force on the forward portion of the restraint actuator to move the restraint actuator toward the rear position to enable exit of the rimmed cartridge from the cartridge pocket.

2. The speed loader of claim 1 including a separate restraint element for each cartridge pocket.

3. The speed loader of claim 1 wherein the restraint actuator is rotationally disengaged from the body.

4. The speed loader of claim 1 wherein the restraint actuator is a surface of revolution.

5. The speed loader of claim 1 wherein the restraint actuator does not rotate.

6. The speed loader of claim 1 wherein the restraint actuator remains in a selected orientation without rotation as it moves between the forward position and the rearward position.

7. The speed loader of claim 1 wherein the restraint actuator is in the same rotational orientation in the forward position and the rearward position.

* * * * *